US010550525B2

(12) United States Patent
Lichtberger

(10) Patent No.: US 10,550,525 B2
(45) Date of Patent: Feb. 4, 2020

(54) METHOD AND DEVICE FOR COMPACTING THE BALLAST BED OF A TRACK

(71) Applicant: HP3 Real GmbH, Vienna (AT)

(72) Inventor: Bernhard Lichtberger, Pregarten (AT)

(73) Assignee: HP3 Real GmbH, Vienna (AT)

( * ) Notice: Subject to any disclaimer, the term of this patent is extended or adjusted under 35 U.S.C. 154(b) by 284 days.

(21) Appl. No.: 15/525,575

(22) PCT Filed: Nov. 26, 2015

(86) PCT No.: PCT/AT2015/050301
§ 371 (c)(1),
(2) Date: May 9, 2017

(87) PCT Pub. No.: WO2016/081971
PCT Pub. Date: Jun. 2, 2016

(65) Prior Publication Data

US 2017/0328013 A1 Nov. 16, 2017

(30) Foreign Application Priority Data

Nov. 28, 2014 (AT) ..... A 50862/2014

(51) Int. Cl.
*E01B 27/17* (2006.01)
*E01B 35/06* (2006.01)

(52) U.S. Cl.
CPC ..... *E01B 27/17* (2013.01); *E01B 35/06* (2013.01); *E01B 2203/10* (2013.01); *E01B 2203/125* (2013.01)

(58) Field of Classification Search
CPC ..... E01B 27/17; E01B 35/06; E01B 2203/10; E01B 2203/125
See application file for complete search history.

(56) References Cited

U.S. PATENT DOCUMENTS 3,832,952 A * 9/1974 Hurni ..... E01B 27/17 104/7.2
4,248,154 A * 2/1981 Theurer ..... E01B 27/17 104/12
4,986,189 A * 1/1991 Theurer ..... E01B 27/17 104/12

(Continued)

FOREIGN PATENT DOCUMENTS

CH 536901 6/1973
DE 28 53 529 A1 11/1979
DE 39 23 733 A1 8/1990

*Primary Examiner* — Jason C Smith
(74) *Attorney, Agent, or Firm* — Tiajoloff & Kelly LLP

(57) ABSTRACT

A method and device for compacting the ballast bed of a track, especially in the region of a switch, comprising a switch tamping machine (1), which is fitted with a tamping unit (4), a lifting and lining device (2) comprising at least one pair of roller pincers (6) and at least one lifting hook (7) for lining the track position, and which is guided in a longitudinally displaceable manner on the machine frame (2) in the longitudinal direction of the machine. In order to provide advantageous lining conditions, it is proposed that a switch component measuring system (3), which is provided upstream of the lifting and lining device (2) in the working direction (C), is provided for the position-dependent measurement of the position of the switch components.

19 Claims, 6 Drawing Sheets

(56) References Cited

U.S. PATENT DOCUMENTS

| | | | | |
|---|---|---|---|---|
| 2004/0031412 | A1* | 2/2004 | Theurer | E01B 27/17 104/12 |
| 2004/0069180 | A1* | 4/2004 | Theurer | E01B 27/17 104/10 |
| 2010/0064928 | A1* | 3/2010 | Theurer | E01B 27/16 104/10 |
| 2012/0318162 | A1* | 12/2012 | Theurer | E01B 27/17 104/7.1 |
| 2015/0211192 | A1* | 7/2015 | Lichtberger | E01B 27/20 104/12 |
| 2017/0284033 | A1* | 10/2017 | Lichtberger | E01B 1/001 |
| 2017/0328013 | A1* | 11/2017 | Lichtberger | E01B 27/17 |
| 2018/0298564 | A1* | 10/2018 | Lichtberger | E01B 27/17 |
| 2019/0271120 | A1* | 9/2019 | Springer | B06B 1/18 |

* cited by examiner

METHOD AND DEVICE FOR COMPACTING THE BALLAST BED OF A TRACK

FIELD OF THE INVENTION

The invention relates to a method for controlling the lifting and lining device of a track-driveable switch tamping machine, comprising a tamping unit, one pair of roller pincers and at least one lifting hook, wherein the lifting and lining device is guided in a longitudinally displaceable manner in the longitudinal direction of the machine. Furthermore, a device is proposed for compacting the ballast bed of a track, especially in the region of a switch, with a switch tamping machine, which is fitted with a tamping unit with a lifting and lining device having at least one pair of roller pincers and at least one lifting hook for lining the track position.

DESCRIPTION OF THE PRIOR ART

Switch tamping machines are machines for correcting the track position of switches. Measurement systems are used for determining the track position which measure the actual height position of the track, the actual direction of the track and the actual position of the superelevation of the track during work and adjust them to predetermined target values. The track grid is lifted by means of a track lifting/track lining unit and is laterally adjusted until the difference between the predetermined target position and actual position is zero. In this position, the track is fixed by compacting the ballast beneath the sleepers by means of a switch tamping unit. The lifting and lining of the track grid occurs via hydraulic lifting and lining cylinders with proportional or servo control. Switches comprise a continuous track and a diverging track as a special feature. Trains are guided via so-called switch blades to the diverging track or held on the continuous main track. The so-called cross frog is disposed in the crossover point of the continuous track and the diverging track. In the region of the cross frog, the railway wheel must be guided from the rail of the continuous track to the rail of the diverging track. In order to ensure that the wheel that is not guided in the interruption region roles securely into the diverging track or the continuous main track, guide rails are provided. In order to ensure that the working tools of the switch tamping machine are capable of tamping beneath the sleepers of the switch at all locations, the tamping units are laterally displaceable and the tamping units are rotatable as a result of the obliquely disposed longitudinal sleepers. The tamping tines can additionally be formed in a pivotable manner at least in part.

In the case of pure track tamping machines, the rail is gripped at the head by roller pincers and lifted to the geometric target position. A use of the roller pincers is often not possible in switches due to the crossing rails and in the cross frog. In order to ensure that these points can also be processed (and lined), laterally extendable and adjustable lifting hooks which are height adjustable in the depth are additionally provided.

In addition to pure switch tamping machines and track tamping machines there are also universal machines which can be used both for the track region and also for the switch region. Two working cabins are frequently used in the universal machines. The cabin for the switch tamping is situated with respect to its direction of vision against the working direction. The machine operator controls the position of the tamping unit, i.e. the tines, from the switch tamping cabin. The operator selects the roller pincers or the lifting hook or the position of the lifting hook as well as the point of attack thereof on the rail head or rail base according to the conditions and as required. The lifting device can also be displaced in the longitudinal direction of the track. This is necessary when the lifting hook acts on the rail base (which is only possible in the region of the intermediate compartment) or when the roller pincers or the lifting hook for example is unable to close on the rail head by an insulated joint. The switch tamping cabin is especially selected due to the better vision of the lifting and lining device of the switch tamping machine. The track tamping machine lies in the working direction with respect to the direction of view.

In the case of a track tamping, tamping is only carried out with the roller pincers because no obstructions occur as in the case of switches. In the case of track tamping, which is usually carried out at higher working speeds, the view of the tamping units is especially important so that they enter the intermediate compartment precisely and do not damage the sleepers with the tamping tools (the so-called tamping tines). There is poor visibility of the lifting device from the track tamping cabin because the tamping units block the view. The disadvantage of providing two working cabins lies in the considerable additional expense for the configuration, i.e. two cabins, two control devices, additional weight and increased need for space. Currently, in the configuration of a universal tamping machine with only one working cabin (usually the one for the track tamping) the visibility of the lifting device is provided by video cameras. Video cameras can replace spatial vision only to an inadequate extent. The manual setting of the lifting device, the selection of the roller pincers and the lifting hooks, the positioning of the lifting hook and the point of attack of the force, as well as the displacement of the lifting device in the longitudinal direction of the track require time. Displacement-measuring devices via odometers or other methods are also known. Since the target track geometry with respect to the arc length of the track is defined, the current position of the machine must be detected with respect to the kilometer mileage.

SUMMARY OF THE INVENTION

The invention is therefore based on the object of providing a method for the automatic control of the roller pincers and the lifting hook for lifting switches by switch tamping machines with which the working speed can be increased and the possibilities of errors can be minimised. Furthermore, only one working cabin is required, as a result of which the switch tamping machine can optionally be formed in a shorter way.

This object is achieved by the invention in such a way that the position of switch components such as especially the switch drive boxes, rails and the cross frog is measured and intermediately stored during the advancement of the switch tamping machine in a position-dependent manner in the transverse direction of the track by means of a switch component measuring system which is arranged upstream of the lifting and lining device in the working direction, that the position of the sleepers and the intermediate compartments in the working direction are detected and intermediately stored, that the detected values for the working position of the roller pincers and the lifting hook are queried, that on the basis of these values a check is carried out whether the roller pincers can be used at this working position and, if the roller pincers cannot be used, a check is made on the basis of these values in the respect of whether the lifting hook can act on the rail head and, if this is also not possible, that optionally a displacement of the lifting hook in the longitudinal direction of the machine is carried out in such a way that the lifting hook comes to a standstill at the rail base close to an intermediate compartment, and that the lifting is carried out after gripping the rail with the lifting and lining device.

In accordance with the invention, the position of the switch components is detected by means of the switch component measurement system, which is provided upstream of the lifting and lining device in the working direction, and is stored dependent on the path. A random number of substantially one-dimensional momentary recordings of the track cross-section in top view are thus carried out and stored in a database. A digital image of the track and the switch components in particular can be produced from the stored data. On the basis of said data, the lifting and lining device is optionally automatically displaced in a respective manner in the longitudinal direction of the track along a guide on the machine frame in order to access a suitable point of attack for the lifting and lining tool. Furthermore, the suitable lifting and lining tool is selected depending on the measured values of the switch component measuring system, i.e. a selection is therefore made between the roller pincers and the lifting hook and the extension position of the lifting hook as well as the point of attack of the lifting hook on the rail base or rail head is automatically selected by a control or regulating unit. One of the two working cabins can thus be omitted. The automatic control of the roller pincers and the lifting hook compensates the more adverse view of the roller pincers and lifting hook from the switch tamping cabin and increases the working speed. A video system can additionally be used for monitoring the roller pincers and the lifting hook.

In accordance with the invention, the position of the track components, especially the switch components (position of the rails, the cross frog, wing rails, switch tongue, drive boxes for the switch tongues etc), are detected in advance depending on the path in the working direction with respect to the lifting and lining device. The detection of said components made of steel can be carried out for example by means of a number of inductive or capacitive proximity sensors, ultrasonic sensors or a laser scanner (equidistant scanning every 5 cm for example). The position of the switch components is stored depending on the path and transposed by a computer system in a locally shifted manner to the position of the roller pincers or the lifting hook. The progression of the machine over the path is measured via a distance measuring unit, e.g. an odometer. The preceding measurements are evaluated for the respective position of the lifting and lining unit. If no adequate space is determined for manipulating the roller pincers, an automatic switchover is made to the lifting hook. The extension position of the lifting hook and the rail head as the point of attack are selected at first depending on the preceding measurement and the intermediately stored data for the current location of the lifting and lining unit. It can be concluded by the measurement of the extension position and the closing path of the lifting hook whether or not the head was gripped securely by the hook. If the closing path is inadequate, the hook is automatically opened again. If the lifting hook is not located above the intermediate compartment, the lifting and lining unit is displaced in the longitudinal direction of the track until the lifting hook is disposed above the intermediate compartment. The attempt to close on the rail head is carried out again at this new position and if it is unsuccessful (because an insulated joint is present for example) the rail base is selected as the point of attack for the force. If the roller pincers unsuccessfully grip the rail head, then this can be determined via the distance measurement of the hydraulic closing cylinder, whereupon the lifting and lining unit is moved to a position in the longitudinal direction of the track where closing is possible. If no such position is achieved, then the lifting hook is automatically triggered with a point of attack on the rail base. The measuring device detects the position of the switch components in the transverse direction of the track on the side of the lifting devices (always outside on the rail). The rail track is applied as the reference point on which the switch tamping machine and the lifting and lining device travel.

A gripping position for the lifting and lining unit is determined from the position of the switch components detected by the switch component measuring system, and said gripping position is automatically accessed prior to a closure of the roller pincers or prior to a gripping of the rail with the lifting hook, especially by transverse displacement, longitudinal displacement and depth adjustment of the lifting and lining system.

The switch component measuring system detects the position of the switch components preferably by means of a sensor strip comprising a plurality of individual sensors, which sensor strip is provided upstream of the lifting and lining device in the working direction transversely to the longitudinal direction of the machine and is fitted with a number of inductive sensors and/or capacitive sensors and/or laser distance sensors and/or ultrasonic distance sensors. Similarly, the switch component measuring system can detect the position of the switch components with at least one laser scanner.

A device in accordance with the invention for compacting the ballast bed of a track, especially in the region of a switch, comprising a switch tamping machine, which is fitted with a tamping unit, a lifting and lining device comprising at least one pair of roller pincers and at least one lifting hook for lining the track position, and which is guided in a longitudinally displaceable manner on the machine frame in the longitudinal direction of the machine, is characterized in that a switch component measuring system, which is provided upstream of the lifting and lining device in the working direction, is provided for the position-dependent measurement of the position of the switch components. In order to ensure that the individual positions were securely accessed or the track was securely gripped, the lifting hook of the lifting and lining device can be associated with a lifting hook depth adjustment cylinder with a displacement path sensor, the roller pincers of the lifting and lining device can be associated with a roller pincer closing cylinder with a closing path sensor, and the lifting and lining device can be associated with a transverse displacement cylinder with a displacement path sensor.

An especially simple and robust switch component measuring system is obtained if it comprises a sensor strip which preferably comprises a plurality of individual sensors, which sensor strip is provided on the switch tamping machine, oriented transversely to the longitudinal direction of the machine. Furthermore, the sensor strip can comprise a plurality of individual sensors which are arranged one behind the other in the longitudinal direction of the strip, i.e. in a row. It is recommended according to an advantageous embodiment of the invention if the individual sensors, which are arranged one behind the other in the longitudinal direction of the strip, are arranged in two or more rows adjacent to each other, wherein the individual sensors of adjoining sensor strips are preferably arranged in a staggered manner with respect to each other. The switch component measuring system can comprise inductive sensors, capacitive sensors, laser distance sensors and/or ultrasonic distance sensors or optionally at least one laser scanner.

BRIEF DESCRIPTIONS OF THE DRAWINGS

The subject matter of the invention is shown by way of example in the drawings, wherein.

Figure 6:
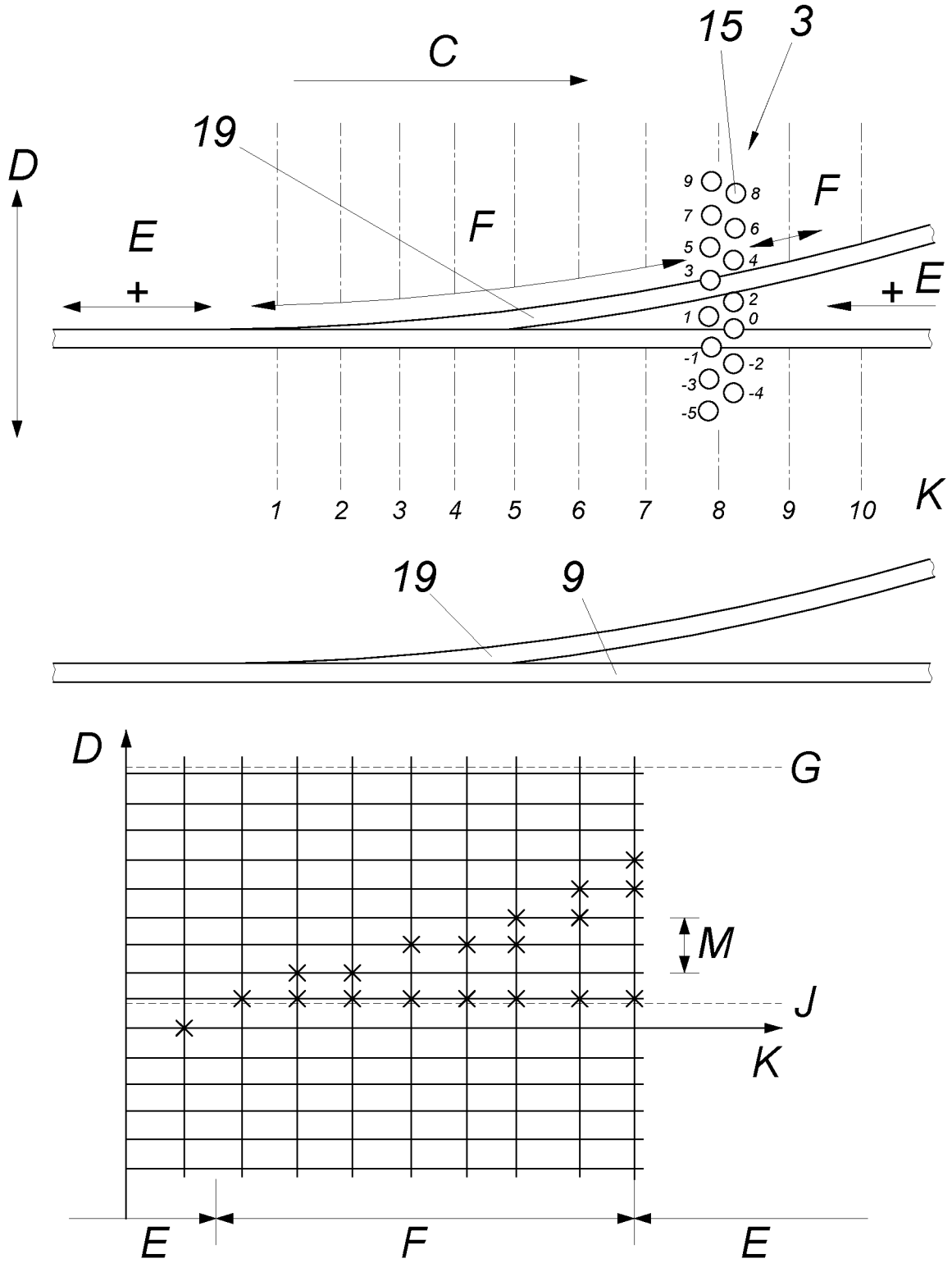
Figure 7:
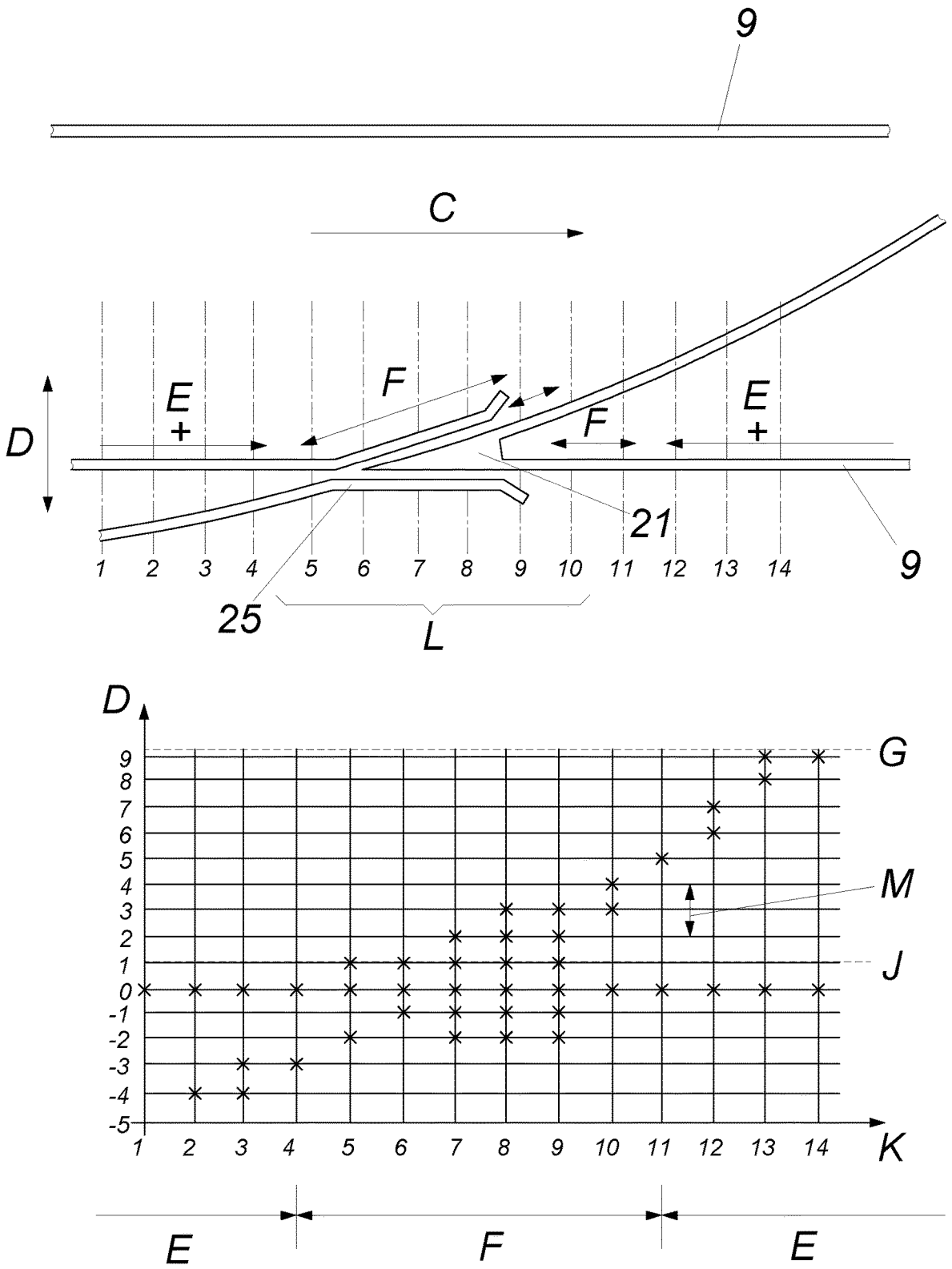

FIGS. 6 and 7 each show an illustration of the switch blade region of switches, the measuring device for detecting the position of the track components in the transverse direction of the track and, by way of example, the stored measured data of such a measuring device.

DESCRIPTION OF THE PREFERRED EMBODIMENTS

Figure 1:
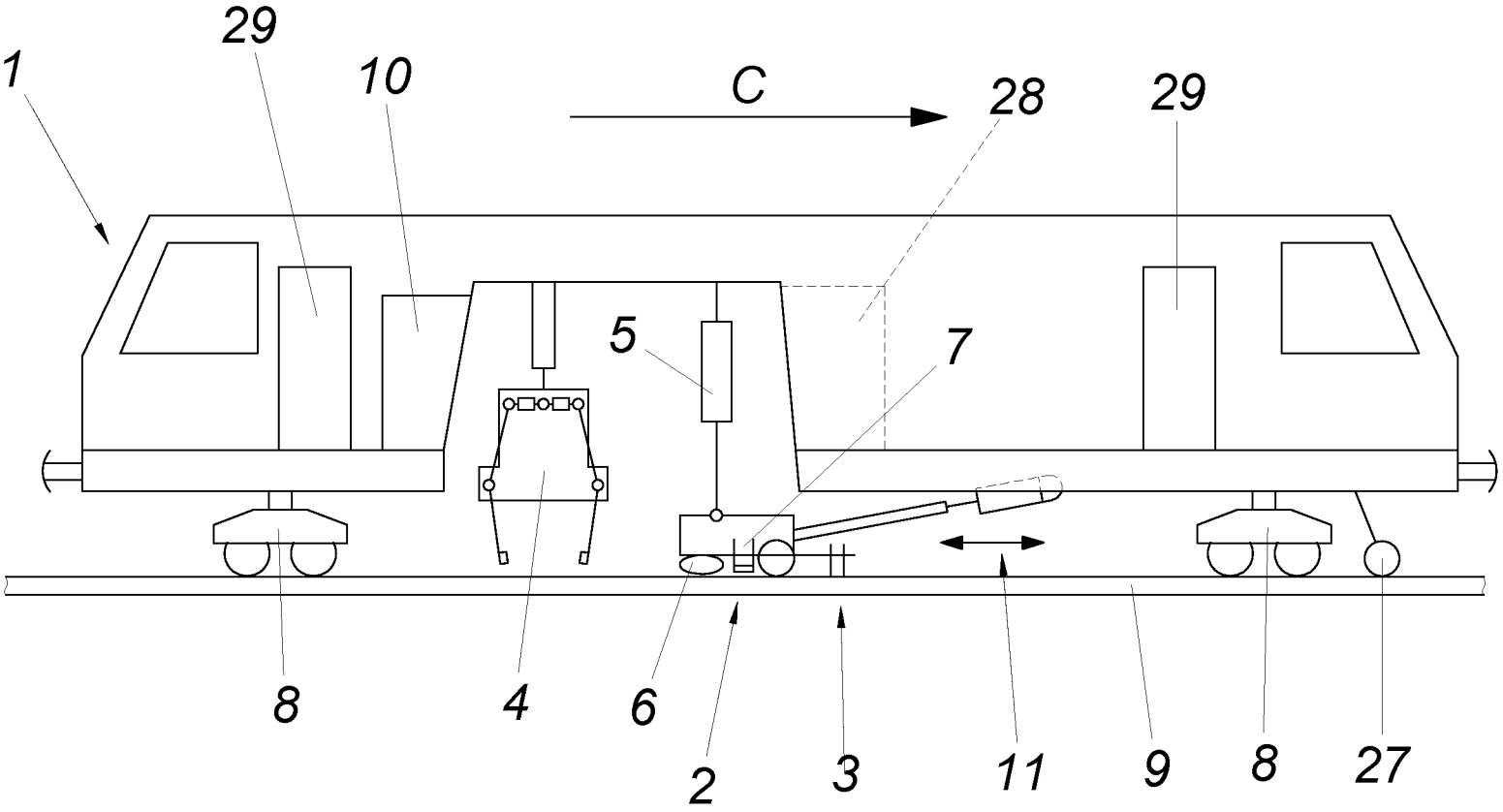
FIG. 1 shows a track driveable track tamping machine in a side view.

A switch tamping machine 1 comprises a tamping unit 4 and a track lifting and lining unit 2 comprising a lifting cylinder 5, a pair of roller pincers 6, a lifting hook 7 and a measuring device 3 (FIG. 1). The lifting and lining device can be displaced via a hydraulic cylinder in the longitudinal direction 11 of the track. The switch tamping machine is displaceable on the rail 9 via undercarriages 8. The control of the switch tamping machine 1 occurs from the working cabin 10 which is arranged in the working direction C behind the tamping unit 4. The working cabin 10 and the driver's cabs can be accessed via lateral doors 29. The arc length of the track is determined by a distance measuring device 27. The usually provided second switch tamping cabin 28 can be omitted in the embodiment in accordance with the invention. The switch component measuring system 3 for the position-dependent measurement of the position of switch components is provided upstream of the lifting and lining device 2 in the working direction C.

Figure 2:
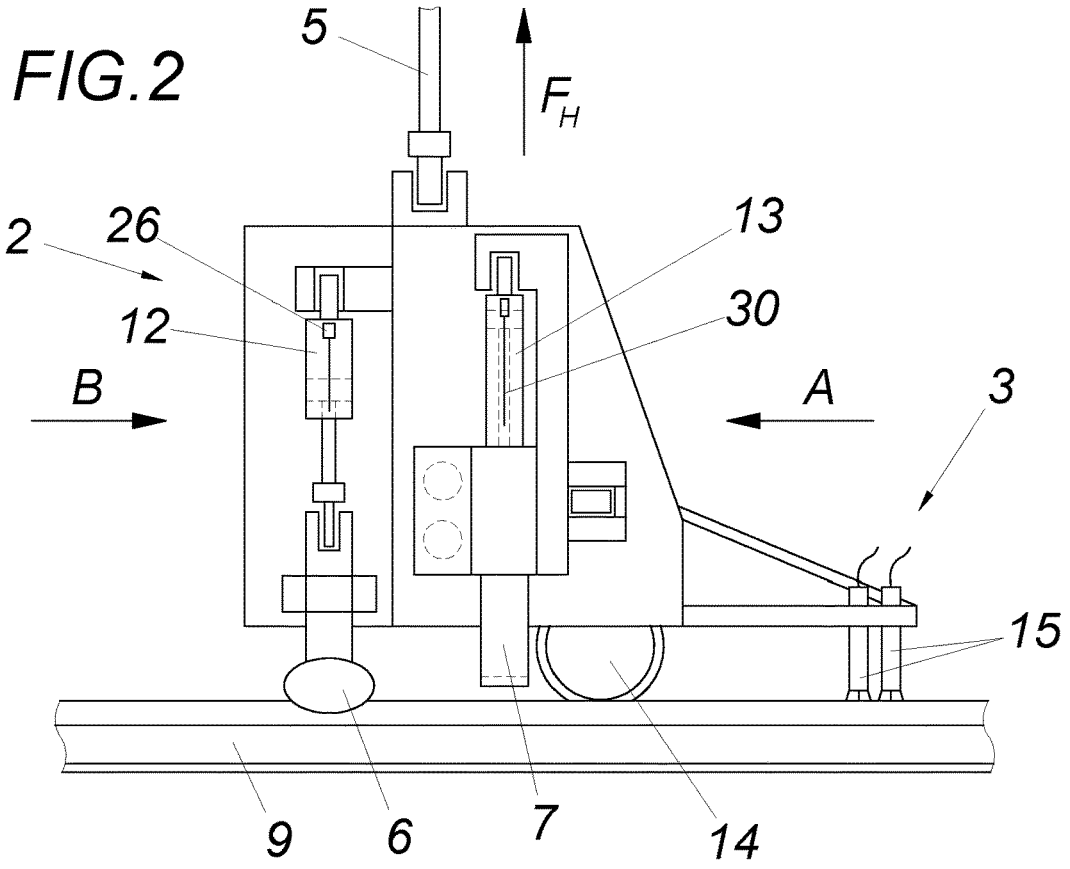
FIG. 2 shows a side view of a lifting and lining device in accordance with the invention with a roller pincers and transversely displaceable and depth-adjustable lifting hooks, as well as a measuring device for detecting the track components.

The lifting and lining device (FIG. 2) comprises a pair of roller pincers 6, a roller pincer closing cylinder 12 with a closing path sensor 26, a lifting cylinder 5 with the lifting force $F_H$, a hook depth cylinder 13 with a depth transducer 30 for the lifting hook, a switch component measuring system 3 with switch component detection sensors 15, a lifting hook 7 and a guide lining wheel 14. The lifting and lining unit 2 is guided via wheels 14 along the rail 9.

Figure 3:
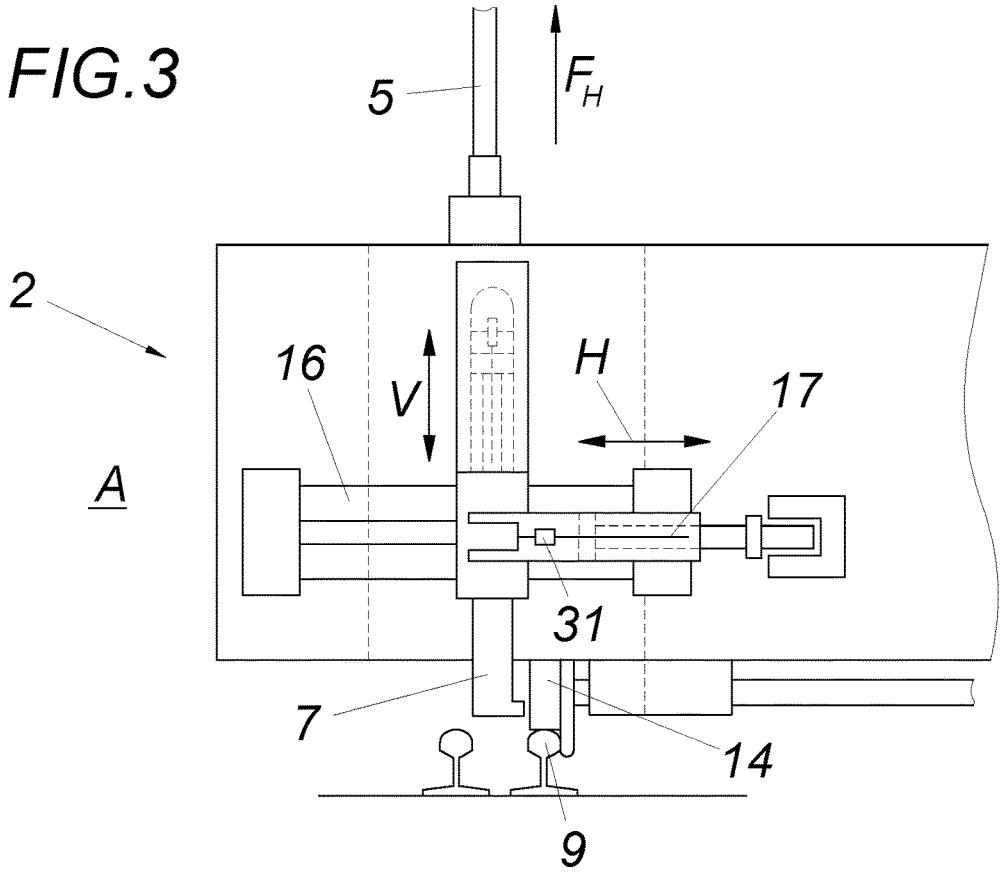
FIG. 3 shows a front view of a lifting and lining device with illustration of the transversely displaceable and depth-adjustable lifting hook with displacement detection of the cylinder movements.

The view according to FIG. 3 of the lifting and lining device 2 especially shows the guide device 16 for the transverse displacement of the lifting hook 7, the lifting hook displacement cylinder 17 with the displacement path sensor 31, the guide lining wheel 14, the lifting cylinder 5 and the guide rail 9.

Figure 4:
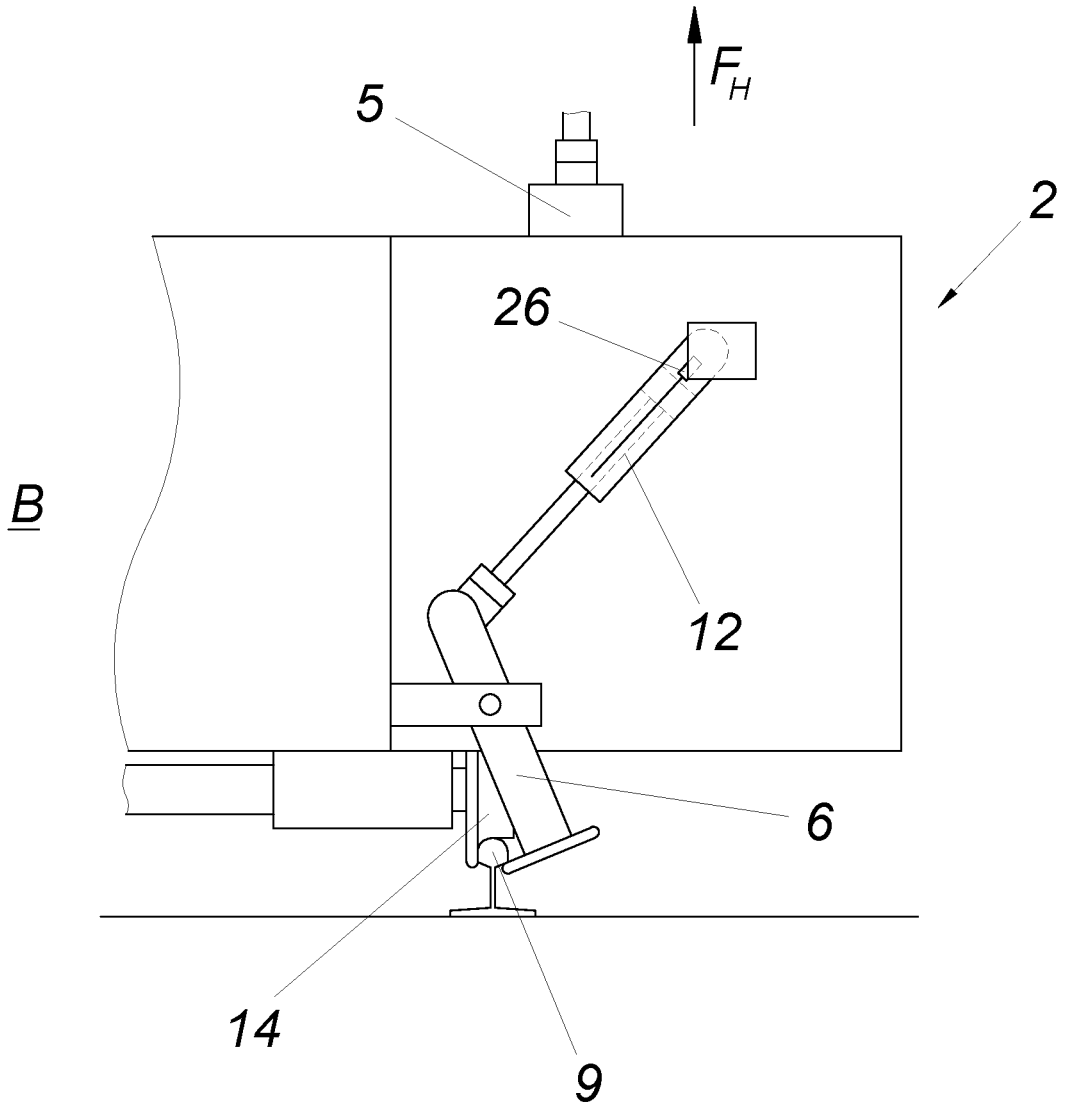
FIG. 4 shows a pair of roller pincers with displacement detection of the closing movement in a front view.

The view according to FIG. 4 of the lifting and lining device 2 shows the pair of roller pincers 6, the roller pincer closing cylinder 12 with the closing path sensor 26, the lifting cylinder 5 with the lifting force $F_H$, the guide rail 9 and the guide lining wheel 14.

Figure 5:
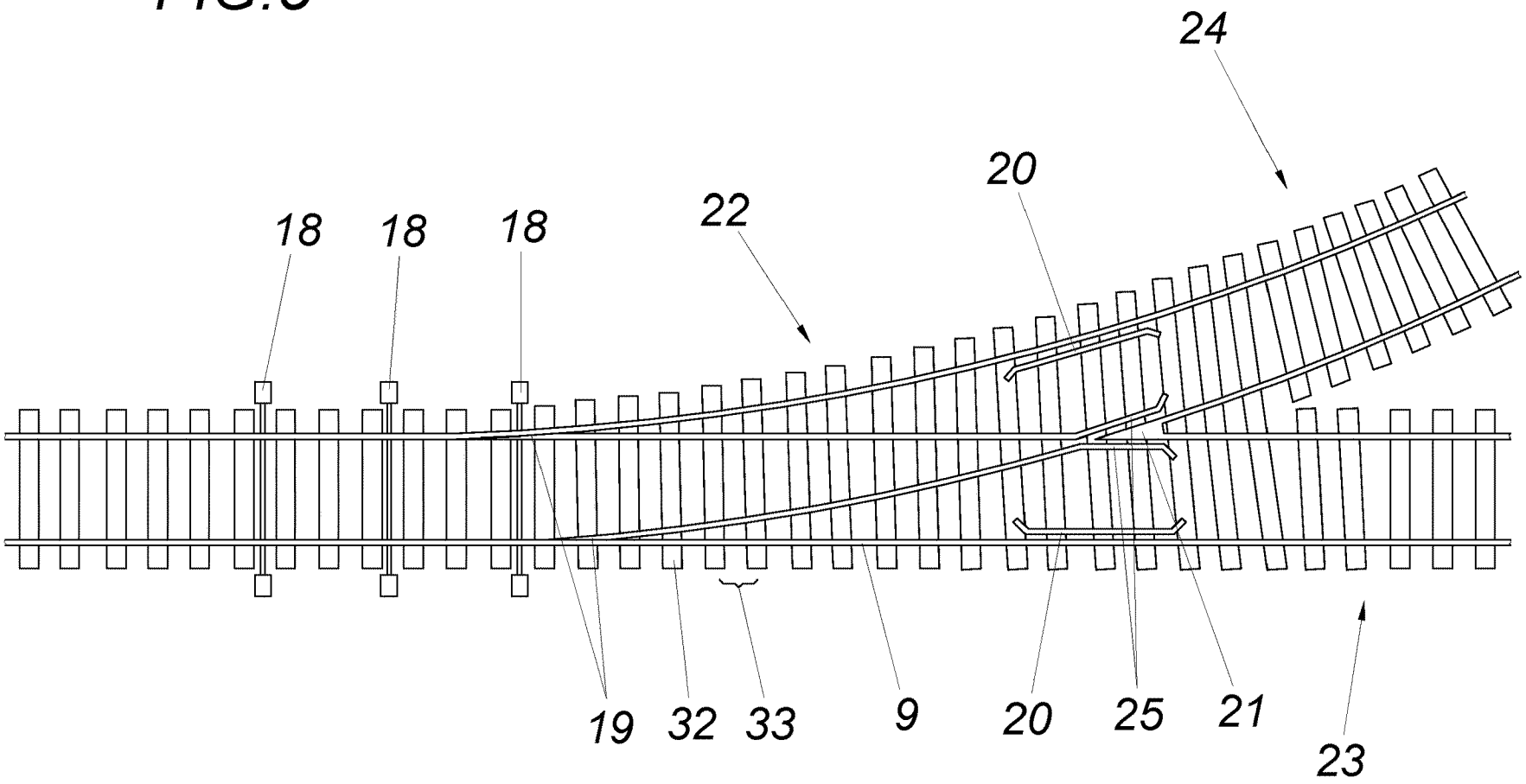
FIG. 5 shows a top view of a switch with switch components such as switch blades, switch blade drive, cross frog, wing rails and guide rails, as well as the longitudinal sleepers, the continuous and the diverging track.

FIG. 5 shows the schematic top view of a switch 22 to be aligned with the relevant switch components, namely the switch blade drives 18, the switch blades 19, the guide rails 20, the cross frog 21, the wing rails 25, the continuous main track 23, the sleepers 32, the intermediate compartments 33 and the diverging track 24.

The switch blade region 19 is schematically shown in the upper part of FIG. 6. In the transverse direction, i.e. transversely to the working direction C, the obstruction position D is retained, K corresponds to the track position of the switch component measuring system 3 which consists in the indicated exemplary embodiment of individual switch component detection sensors 15. The switch component detection sensors 15 are arranged in two rows extending adjacent to each other, wherein the individual sensors of adjacent sensor rows are arranged in a staggered manner with respect to each other. 19 shows the switch blade, 9 shows the continuous track, E indicates the region in which the pair of roller pincers 6 is used, F shows the position in which the lifting hook 7 needs to be used. C indicates the working direction. In the bottom region of the illustration, the vertical axis D indicates the obstruction position and the horizontal axis K shows the track position where the measuring device 3 was situated at the time of the measurement. The crosses in the diagram indicate where the distance sensors 15 actively detected a switch component. The diagram also contains the maximum hook extension limit G and the maximum roller pincer limit J in which there is sufficient clearance for closing the pair of roller pincers 6. M shows the required clearance from which the pair of roller pincers 6 can be used.

The cross frog region L is shown in the upper part of FIG. 7. The obstruction position D is indicated in the transverse direction, K corresponds to the track position of the measuring device 3 which consists of individual distance sensors 15 in the indicated exemplary embodiment. E indicates the region in which the pair of roller pincers 6 is used, F shows the position in which the lifting hook 7 needs to be used. C indicates the working direction. In the bottom region of the illustration, the vertical axis D indicates the obstruction position and the horizontal axis K shows the track position where the measuring device 3 was situated at the time of the measurement. The crosses in the diagram indicate where the distance sensors 15 actively detected a switch component. The diagram also contains the maximum hook extension limit G and the maximum roller pincer limit J in which there is sufficient clearance for closing the pair of roller pincers 6. M shows the required clearance from which the pair of roller pincers 6 can be used. 21 represents the cross frog and 25 represents the wing rails.

The invention claimed is:

1. A method for controlling a lifting and lining device of a switch tamping machine that is drivable on a track and has a tamping unit, a pair of roller pincers, and at least one lifting hook, said method comprising:

guiding the lifting and lining device in a longitudinally displaceable manner in a longitudinal direction of the machine;

measuring and storing intermediately a position of one or more switch components including at least one of switch drive boxes, rails and a cross frog during advancement of the switch tamping machine in a position-dependent manner in a transverse direction of the track using a switch component measuring system that is arranged upstream of the lifting and lining device in a working direction, detecting and intermediately storing a position of sleepers and intermediate compartments in the working direction, querying detected values for a working position of the pair of roller pincers and the lifting hook, carrying out a first check based on said detected values whether the pair of roller pincers can be used at said working position and, responsive to said first check determining that the pair of roller pincers cannot be used, making a second check based on said detected values whether the lifting hook can act on the rail head, and gripping the rail with the lifting and lining device and lifting the rail.

2. A method according to claim 1, wherein the method further comprises determining from the position of the switch components detected by the switch component measuring system a gripping position for the lifting and lining device, and automatically accessing said gripping position prior to the closure of the pair of roller pincers or prior to said gripping of the rail by the lifting hook.

3. A method according to claim 1, wherein the switch component measuring system detects the position of the switch components by a sensor strip arranged extending transversely to the longitudinal direction of the machine, upstream of the lifting and lining device in the working direction.

4. A method according to claim 1, wherein the switch component measuring system detects the position of the switch components by a number of inductive sensors and/or capacitive sensors.

5. A method according to claim 1, wherein the switch component measuring system detects the position of the switch components by a number of laser distance sensors and/or ultrasonic distance sensors.

6. A method according to claim 1, wherein the switch component measuring system detects the position of the switch components by at least one laser scanner.

7. A device for compacting the ballast bed of a track, in the region of a switch, said device comprising:

a switch tamping machine fitted with a tamping unit, a lifting and lining device comprising at least one pair of roller pincers and at least one lifting hook configured to line the track position, and guided in a longitudinally displaceable manner on a machine frame in a longitudinal direction of the machine, wherein a switch component measuring system is provided upstream of the lifting and lining device in a working direction, said switch component measuring system providing position-dependent measurement of a position of switch components.

8. A device according to claim 7, wherein a lifting hook depth adjustment cylinder with a displacement path sensor is associated with the lifting hook of the lifting and lining device.

9. A device according to claim 7, wherein the pair of roller pincers of the lifting and lining device is associated with a roller pincer closing cylinder with a closing path sensor.

10. A device according to claim 7, wherein the lifting and lining device is associated with a transverse displacement cylinder with a displacement path sensor.

11. A device according to claim 7, wherein the switch component measuring system that is provided upstream of the lifting and lining device in the working direction comprises a sensor strip provided on the switch tamping machine oriented transversely to the longitudinal direction of the machine.

12. A device according to claim 11, wherein the sensor strip comprises a plurality of individual sensors arranged one behind the other in the longitudinal direction of the strip.

13. A device according to claim 12, wherein the individual sensors arranged one behind the other in the longitudinal direction of the strip are arranged in two or more rows extending adjacent to each other.

14. A device according to claim 7, wherein the switch component measuring system comprises inductive sensors, capacitive sensors, laser distance sensors and/or ultrasonic distance sensors or optionally at least one laser scanner.

15. A method according to claim 1, wherein, responsive to said second check determining that the lifting hook cannot act on the rail head, a displacement of the lifting hook in the longitudinal direction of the machine is carried out such that the lifting hook comes to a standstill at the rail base close to an intermediate compartment.

16. A method according to claim 2, wherein said gripping position is automatically accessed prior to the closure of the pair of roller pincers or prior to said gripping of the rail by the lifting hook, especially by transverse displacement, longitudinal displacement and depth adjustment of the lifting and lining device.

17. A method according to claim 3, wherein the sensor strip that comprises a plurality of switch component detection sensors.

18. A device according to claim 11, wherein the sensor strip comprises a plurality of individual sensors.

19. A device according to claim 13, wherein the individual sensors of adjoining sensor rows are preferably arranged in a staggered manner with respect each other.

* * * * *